US009546658B2

(12) United States Patent
Bohner et al.

(10) Patent No.: US 9,546,658 B2
(45) Date of Patent: Jan. 17, 2017

(54) GAS PUMP WITH A SEALING OIL GROOVE

(71) Applicant: Schwäbische Hüttenwerke Automotive GmbH, Aalen-Wasseralfingen (DE)

(72) Inventors: Jürgen Bohner, Bad Waldsee (DE); Sven Peters, Bad Schussenried (DE)

(73) Assignee: SCHWÄBISCHE HÜTTENWERKE AUTOMOTIVE GMBH, Aalen-Wasseralfingen (DE)

( * ) Notice: Subject to any disclaimer, the term of this patent is extended or adjusted under 35 U.S.C. 154(b) by 311 days.

(21) Appl. No.: 14/101,510

(22) Filed: Dec. 10, 2013

(65) Prior Publication Data

US 2014/0161645 A1 Jun. 12, 2014

(51) Int. Cl.
*F01C 21/10* (2006.01)
*F04C 25/02* (2006.01)
(Continued)

(52) U.S. Cl.
CPC ..... *F04C 27/02* (2013.01); *F04C 2/356* (2013.01); *F04C 18/3442* (2013.01);
(Continued)

(58) Field of Classification Search
CPC ..... F01C 19/00; F01C 21/10; F01C 21/104; F01C 21/106; F04C 15/0034; F04C 27/008; F04C 27/02; F04C 23/001; F04C 25/02; F04C 29/02; F04C 18/3442; F04C 2220/50; F04C 2240/30; F04C 28/02; F04C 29/128; F04C 18/126; F04C 19/00; F04C 2230/602; F04C 2240/70; F04C 23/003; F04C 28/06; F04C 28/16; F04C 29/025; F04C 2/3442; F04C 2/356; Y10S 277/913; F04B 1/053; F04B 27/053; F04B 35/01; F04B 9/045; F16C 19/386;F16C 2300/62; F16C 2326/02; F16C 33/7879; F16C 33/7886; F16C 33/7896; F16C 33/805; F16J 15/14; F16J 15/3256; F16J 15/002; F25B 27/00; Y10T 137/788; Y10T 137/7881; Y10T 29/49238; Y10T 29/49245; Y10T 29/49885
(Continued)

(56) References Cited

U.S. PATENT DOCUMENTS

| | | | |
|---|---|---|---|
| 3,791,780 | A | 2/1974 | Fritch et al. |
| 3,982,864 | A | 9/1976 | Cain |

(Continued)

FOREIGN PATENT DOCUMENTS

| | | | |
|---|---|---|---|
| CN | 101184908 | | 5/2008 |
| CN | 102410223 | A | 4/2012 |
| DE | 10 2006 030 917 | A1 | 12/2007 |
| DE | 10 2010 030 389 | A1 | 12/2011 |
| DE | 10 2011 054887 | A1 | 5/2012 |

OTHER PUBLICATIONS

Office Action dated Aug. 14, 2013 issued for German Appln. No. 10 2012 222 753.9 (6 pages).

(Continued)

*Primary Examiner* — Charles Freay
*Assistant Examiner* — Thomas Cash
(74) *Attorney, Agent, or Firm* — Massina Pat & TM Law PLLC

(57) ABSTRACT

A gas pump including a first housing part (1) comprising a sealing surface (6); a second housing part (2) comprising a sealing surface (7); a delivery chamber (3) comprising an inlet (4) and an outlet (5) for a gas; and a delivery device (11, 12), which can be moved within the delivery chamber (3), for delivering the gas, wherein the housing parts (1, 2) are joined to each other such that they at least partially enclose the delivery chamber (3) over a circumference of the chamber, and such that their sealing surfaces (6, 7) abut each other
(Continued)

in order to seal off the delivery chamber (3), and wherein a sealing recess (9) extends in at least one of the sealing surfaces (6, 7) around the delivery chamber (3) and is filled with a sealing liquid when the gas pump is in operation.

22 Claims, 4 Drawing Sheets

(51) Int. Cl.

| | |
|---|---|
| ***F04C 27/02*** | (2006.01) |
| ***F04C 2/356*** | (2006.01) |
| ***F04C 29/02*** | (2006.01) |
| ***F04C 23/00*** | (2006.01) |
| ***F04C 18/344*** | (2006.01) |
| *F04C 2/344* | (2006.01) |

(52) U.S. Cl.
CPC ..... *F04C 23/001* (2013.01); *F04C 29/025* (2013.01); *F01C 21/10* (2013.01); *F04C 2/3442* (2013.01); *F04C 25/02* (2013.01)

(58) Field of Classification Search
USPC ..... 418/149
See application file for complete search history.

(56) References Cited

U.S. PATENT DOCUMENTS

| | | | | |
|---|---|---|---|---|
| 4,512,728 | A * | 4/1985 | Nakano | B60H 1/3223 418/213 |
| 5,336,059 | A | 8/1994 | Rowley | |
| 6,244,239 | B1 * | 6/2001 | Sisco | F02B 67/06 123/192.1 |
| 2007/0059187 | A1 * | 3/2007 | Lo Biundo | F01M 1/02 417/364 |
| 2010/0226808 | A1 | 9/2010 | Schofield et al. | |
| 2012/0060683 | A1 * | 3/2012 | Peters | F04C 18/3442 91/468 |
| 2013/0017112 | A1 * | 1/2013 | Kinch | F04C 2/3442 418/27 |
| 2013/0092117 | A1 * | 4/2013 | Fleck | F01M 1/02 123/196 R |

OTHER PUBLICATIONS

Extended European Search Report issued Sep. 21, 2015 in European Patent Application No. 13196532.9 (6 pages).
Office Action issued Aug. 10, 2015 in Chinese Patent Application No. 201310664984.9 (7 pages).
Office Action issued Jun. 3, 2016 in connection with Chinese patent application 201310664984.9 (19 pages).

* cited by examiner

GAS PUMP WITH A SEALING OIL GROOVE

This application claims priority to German Patent Appln. No. 10 2012 222 753.9, filed on Dec. 11, 2012, the contents of which are incorporated herein by reference.

FIELD OF THE INVENTION

The invention relates to sealing off a gas pump, in particular, a negative pressure pump.

BACKGROUND OF THE INVENTION

Negative pressure pumps are used in vehicles, for example to provide negative pressure for a brake servo. The pump can be arranged laterally on the cylinder head of a vehicle engine and driven by a cam shaft, as has been typical for a long time. Due to design space restrictions and also in order to reduce the specific design size, the negative pressure pump has in more recent times been arranged in the oil sump, in tandem arrangement with a lubricating oil pump. Due to the relatively great demands made on the strength of seal, it has hitherto been typical to provide a seal by means of an O-ring seal or a profiled form seal. The seal is intended to prevent air from being suctioned from the environment. In pumps attached to the outside of the engine, it is also intended to prevent oil from escaping. If it is arranged in the oil sump, it is no longer mandatory for the oil seal of the system to the outside to be absolute. In practice, the seal only then serves to avoid air being suctioned.

The sealing elements, such as for example O-ring seals and profiled form seals, are produced separately and inserted into a sealing groove of a housing part of the gas pump which encloses the delivery chamber or placed onto a front face of the housing part. They are secured on the housing part for and while being assembled. The sealing elements generate costs which, in particular in mass production such as is typical in vehicle production, can no longer be overlooked. Over the service life of the pump, the strength of seal will also suffer due to material degradation of the sealing elements.

Gas pumps which are embodied as vane cell pumps are for example disclosed in US 2012/0060683 A, U.S. Pat. No. 3,326,456 A and WO 2007/003215 A1.

SUMMARY OF THE INVENTION

It is an object of the invention to provide a gas pump in which the delivery chamber is sealed off in a way which satisfies the practical requirements but is more cost-effective.

The invention proceeds from a gas pump which comprises: a first housing part comprising a sealing surface; a second housing part, likewise comprising a sealing surface; a delivery chamber comprising an inlet and an outlet for a gas; and a delivery device, which can be moved within the delivery chamber, for delivering the gas. The two housing parts alone can together form the delivery chamber and can in particular completely enclose the delivery chamber, aside from one or more inlets and one or more outlets. It is however in principle also possible for the first housing part and the second housing part to enclose the delivery chamber only in concert with one or more other housing parts of the gas pump. One of the two housing parts, for example the second housing part, can in particular be a housing cover which seals off the delivery chamber on one front face. The housing parts are joined to each other such that they enclose the delivery chamber over a circumference of the chamber, at least partially and preferably completely, and such that their sealing surfaces mentioned abut each other, forming a sealing join, in order to seal off the delivery chamber. When joined, the sealing surfaces are preferably pressed against each other, for example by joining the housing parts to each other by means of a screw connection.

In accordance with the invention, a sealing recess extends in at least one of the sealing surfaces around the delivery chamber and is filled with a sealing liquid when the gas pump is in operation. Preferably, the sealing recess is completely filled with the sealing liquid. The fill level of the sealing recess is at least large enough that the sealing liquid situated in the sealing recess ensures, to an extent required for practical purposes, that the delivery chamber is sealed off. In preferred embodiments, the sealing recess is filled with the sealing liquid only. In any event, the strength of seal on the delivery chamber over the sealing join of the sealing surfaces is only ensured by the sealing liquid.

The sealing recess can in particular extend continuously over the entire circumference of the delivery chamber, i.e. over 360°. In modifications, it can be locally interrupted at one or more points along the circumference. It can in principle also extend over only a part of the circumference, although in such embodiments, it preferably extends over the majority of the circumference. The possibility of the housing part in which the sealing recess is provided extending over only a part of the circumference of the delivery chamber is also not to be excluded. In embodiments in which the housing of the gas pump is divided in such a way that only two or more housing parts together completely surround the delivery chamber over 360°, a sealing recess is in preferred embodiments formed in each of these housing parts, preferably in such a way that the sealing recesses provided in the plurality of housing parts together surround the delivery chamber continuously over its entire circumference, i.e. transition into each other and/or connect to each other without interruption. Modifications in the sense mentioned above are however also possible in such embodiments.

The sealing recess is delineated from the sealing surface in which it is formed, both along an inner edge facing the delivery chamber and along an outer edge facing away from the delivery chamber. In other words, the sealing recess is formed within the sealing surface as viewed in a frontal view onto the sealing surface, which does not however exclude the possibility of points along this sealing recess being connected to an inner or outer edge of the sealing surface, for example via one or more groove-shaped channels diverging inwards or outwards from the sealing recess. Such a channel can for example serve to feed the sealing liquid into the sealing recess.

The invention saves on the hitherto separately produced sealing ring, simplifies mounting the gas pump, and consequently reduces costs. In previous seals, in which a sealing ring is inserted in a sealing groove, the sealing groove is typically machine-cut. In a sealing recess in accordance with the invention, machine-cutting can be omitted. The sealing recess can be directly formed during original moulding, for example casting, or latterly incorporated by being embossed, which can again reduce the manufacturing costs. The reduction in the number of parts also reduces the logistical and testing expense in manufacturing the parts and mounting the gas pump.

The gas pump can in particular be embodied as a negative pressure pump and can be used to supply one or more assemblies, preferably one or more assemblies of a motor vehicle, with negative pressure or can be provided for such an application. One application which the invention caters to is that of a vacuum pump for supplying a brake servo or other assembly of a motor vehicle with negative pressure. The invention is not however restricted to such applications; the gas pump can in principle also serve to supply one or more assemblies with pressurised gas. The gas can be air, but can in principle also be another gas.

The gas pump can be embodied as a rotary pump. In such embodiments, the delivery device as viewed in its entirety can be rotatable about a rotational axis in the delivery chamber or can comprise at least one delivery member which can be rotated about a rotational axis in the delivery chamber. The delivery device can also comprise a plurality of delivery members which can be rotated about rotational axes which are spaced from each other. The gas pump can in particular be a vane cell pump, and the delivery device can correspondingly comprise one or more delivery rotors which each comprise one or more vanes.

In preferred embodiments, the sealing recess is connected via a feed to a reservoir or circulation of the sealing liquid, such that the sealing liquid can be fed to the sealing recess when the housing parts are joined. Alternatively, however, the sealing recess can also be closed in a tight seal, without the option of a feed of sealing liquid. Connecting the sealing recess to a reservoir or circulation does however have the advantage that sealing liquid can also be latterly fed to the sealing recess, i.e. after the gas pump has been assembled, for example in order to fill the sealing recess for the first time or in order to re-fill it or in order to compensate for sealing liquid which has penetrated across the sealing join or through an optional local eduction from the sealing recess.

The sealing liquid can be a liquid which is used in the environment of the gas pump for another purpose, for example as a working liquid, such as for example a hydraulic oil, of another assembly. Preferably, a liquid lubricant forms the sealing liquid. This can be the same lubricant as also serves to lubricate the delivery device and/or seal off delivery cells formed in the delivery chamber. If the gas pump is assigned to a combustion engine of a motor vehicle, aircraft or watercraft, then a lubricant which serves to lubricate the combustion engine can in particular have the additional function of also forming the sealing liquid. If a liquid lubricant forms the sealing liquid, the sealing liquid can advantageously serve to lubricate the delivery device and/or serve sealing purposes, for example sealing off delivery cells which are optionally formed within the delivery chamber. In order to be able to fulfil at least one of these functions, a connection can exist between the sealing recess and the delivery chamber, in such a way that lubricant serving as a sealing liquid in the sealing recess can initially penetrate from the sealing recess into the delivery chamber. For this purpose, one or more local connections and/or eductions can for example be provided between the sealing recess and the delivery chamber in the region of the sealing join, or the entire region of the sealing join situated between the sealing recess and the delivery chamber can be uniformly embodied with a certain leakage, in order to allow a slight flow of sealing liquid and/or lubricant, respectively, from the sealing recess into the delivery chamber. In embodiments in which the gas pump is a negative pressure pump, as is preferred, such a flow in the direction of the delivery chamber is aided by the negative pressure which prevails in the delivery chamber when the gas pump is in operation.

The subject-matter of the invention also includes a combined gas pump and liquid pump which serves to supply an assembly with a liquid, for example a working liquid or a liquid lubricant, wherein this liquid has the additional function of also forming the sealing liquid for the gas pump. The liquid pump can in particular be a lubricant pump for supplying a combustion engine or other assembly with liquid lubricant. The liquid pump comprises a delivery chamber, and the delivery chamber comprises an inlet on a low-pressure side of the liquid pump and an outlet on a high-pressure side of the liquid pump, for the liquid. The liquid pump also comprises a delivery device which can be driven and which can perform a delivery movement in the delivery chamber when driven, which delivers the liquid from the inlet to the outlet of the delivery chamber. The inlet can be an inlet of the liquid pump upstream of the delivery chamber or an inlet directly into the delivery chamber. The outlet can be an outlet directly out of the delivery chamber or an outlet of the liquid pump downstream of the delivery chamber. A feed of the type already mentioned above can advantageously be provided in the combined gas and liquid pump and can connect the sealing recess of the gas pump to the low-pressure side or the high-pressure side of the liquid pump.

The liquid pump comprises a housing part which forms one or more chamber walls of the delivery chamber of the liquid pump. One of the housing parts of the gas pump can simultaneously also form this housing part of the liquid pump. The relevant housing part can in particular comprise the sealing surface comprising the sealing recess for sealing off the delivery chamber of the gas pump.

If the gas pump and the liquid pump are rotary pumps, such that the delivery device of the gas pump and also the delivery device of the liquid pump each comprise at least one delivery member which can be rotated about a rotational axis, it is also advantageous if these delivery members are mounted such that they can be rotated about a common rotational axis. While the at least two rotatable delivery members can in principle surround each other, they are however more preferably arranged coaxially next to each other. The at least one rotatable delivery member of the gas pump and the at least one rotatable delivery member of the liquid pump can be rotatable relative to each other; in preferred embodiments, however, they are non-rotationally connected to each other. Preferably, they are jointly driven via a drive wheel, wherein they can be coupled by means of a gear system. They can in particular be arranged on a common shaft. In such embodiments, these delivery members can each be joined, fixedly in terms of torque, to the common shaft. It is also possible for one of the delivery members—either a delivery rotor of the gas pump or a delivery rotor of the liquid pump—to be formed in one piece with the shaft, and for only the other delivery rotor in each case to be non-rotationally connected to the shaft. Embodiments in which the shaft forms both a delivery rotor of the gas pump and a delivery rotor of the liquid pump in one piece are in principle also conceivable, although in many embodiments, this will only be realisable if the housing is divided in the axial direction.

If a feed is provided which connects the sealing recess of the gas pump to the system in which the liquid pump delivers the liquid, the feed can diverge on the high-pressure side of the liquid pump in first embodiments, such that liquid delivered by the liquid pump can pass from the high-pressure side into the sealing recess. The high-pressure side of the liquid pump is understood by the invention to mean the part of the system which extends from the high-pressure side of the delivery chamber of the liquid pump to the furthest downstream point of the system which is to be supplied with the liquid by the liquid pump. While the feed for the sealing recess can in principle also diverge directly on the high-pressure side of the delivery chamber of the liquid pump, it more preferably however diverges downstream of the delivery chamber. If a filter device for cleaning the delivered liquid is connected downstream of the liquid pump, as is typical, the feed for the sealing recess advantageously diverges downstream of the filter device. It is advantageous if the feed diverges upstream of the assembly to be supplied with the liquid, preferably upstream of a first point of the system, after the filter device in the flow path, which is to be supplied with the liquid. The cleaner the liquid fed to the sealing recess, the more favourable the conditions, in particular in embodiments in which the sealing liquid can pass from the sealing recess into the delivery chamber of the gas pump. For short flow paths, it is favourable if the feed diverges close to the liquid pump or close to the delivery chamber.

In second embodiments in which the sealing recess is connected to the liquid system of the liquid pump, the feed diverges on the low-pressure side of the liquid pump. The low-pressure side of the liquid pump comprises the portion of the liquid system located upstream of the liquid pump. The low-pressure side of the liquid pump extends from the low-pressure side of the delivery chamber to a point of the liquid system which lies downstream of all the consumption points of the liquid system and from which the liquid pump suctions the liquid. In most applications, this is a liquid reservoir such as for example a liquid sump. In preferred embodiments, the feed diverges upstream of the delivery chamber of the liquid pump. The feed can in particular diverge while still within a housing of the liquid pump.

In embodiments in which the gas pump and the liquid pump comprise a common housing, the feed for the sealing recess can be situated in or on this common housing, such that a connection which is external in relation to the common housing is not required in order to supply the sealing recess. In embodiments in which the feed diverges on the high-pressure side of the liquid pump downstream of a filter device which serves to clean the liquid, this means that the filter device is likewise arranged in or on the common housing of the pumps in such embodiments. It can however also be advantageous to first guide the liquid out of the common housing to an externally arranged filter device and divert the liquid on the high-pressure side of the liquid pump externally in relation to the common pump housing and guide it back into the housing again and to the sealing recess.

An advantageous situation results if the gas pump is at least partially immersed in liquid, such as for example a liquid lubricant, and the liquid at least partially surrounds the sealing join, which is sealed off by means of the sealing recess, on an exterior side which faces away from the delivery chamber of the gas pump. The surrounding liquid ensures an additional outer seal in the immersed circumferential region of the sealing join. It is particularly advantageous if the surrounding liquid is the same liquid as the sealing liquid, i.e. such that surrounding liquid can penetrate into the sealing recess to a certain extent without any negative effects. Surrounding liquid can for example penetrate in when the gas pump is used as a negative pressure pump and the negative pressure established in the delivery chamber generates a suction effect which reaches into the sealing join. In embodiments in which the gas pump is immersed in liquid over at least some of the circumference of the sealing join, it is advantageous if the surrounding liquid is a lubricant which is suitable for lubricating the delivery device and/or sealing off the delivery chamber of the gas pump or delivery cells formed in the delivery chamber.

The invention does not relate only to a gas pump with a liquid seal in accordance with the invention on its own and to a pump arrangement in which the gas pump is combined with a liquid pump of the type described, preferably in a common housing. The invention also relates to a combustion engine comprising a mounted gas pump or pump arrangement of the type described and also to a vehicle, preferably a motor vehicle, comprising a combustion engine featuring a mounted gas pump or pump arrangement of the type described. The combustion engine can in particular form a drive motor of the vehicle.

BRIEF DESCRIPTION OF THE DRAWINGS

The invention is described below on the basis of example embodiments. Features disclosed by the example embodiments, each individually and in any combination of features, advantageously develop the subject-matter of the claims and also the embodiments discussed above. There is shown:

DETAILED DESCRIPTION OF THE INVENTION

Figure 1:
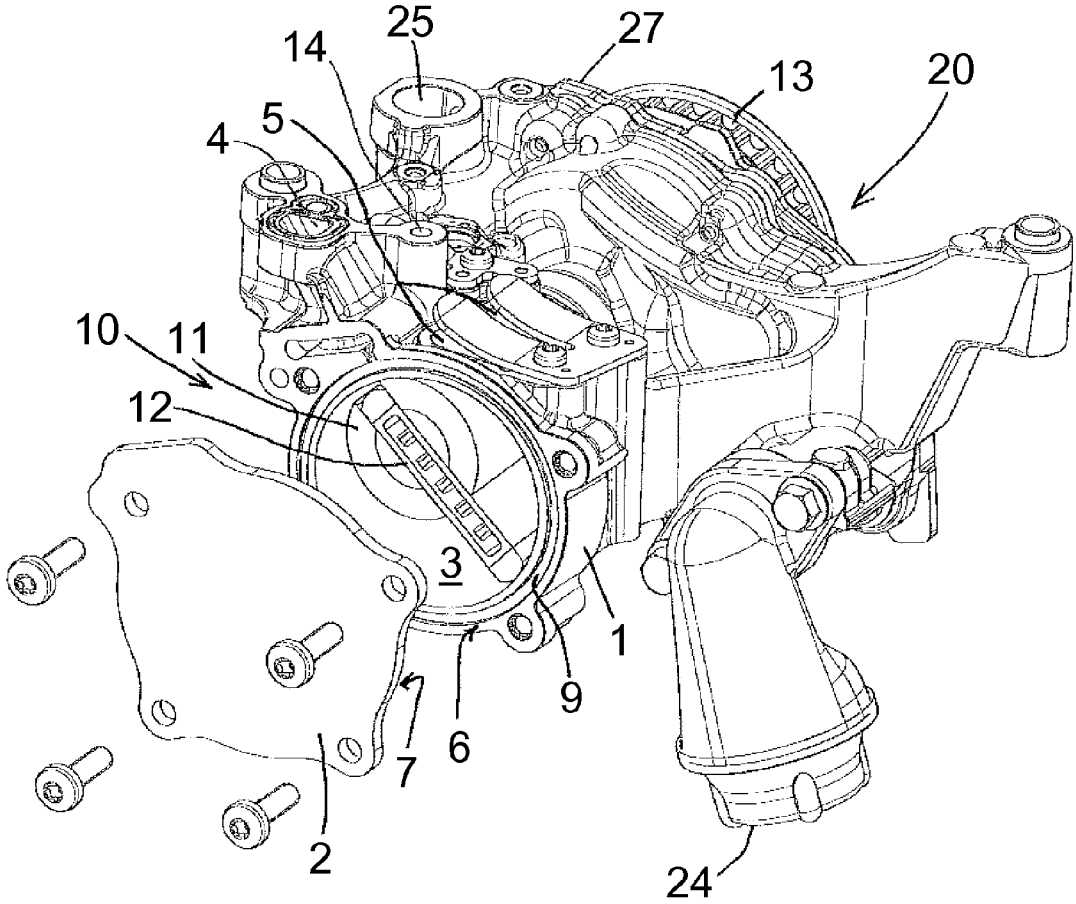
FIG. 1, which is an isometric view onto the gas pump, shows a pump arrangement comprising a gas pump of a first example embodiment.

FIG. 1 shows a pump arrangement of a first example embodiment, in an isometric view onto a gas pump 10 of the pump arrangement. A liquid pump 20 forms a rear part of the pump arrangement in this view. The pump arrangement comprises a housing which is common to both pumps 10 and 20. Such arrangements of pumps are also referred to as a tandem arrangement. The common housing comprises: a housing part 1 which mounts moving components of the pump arrangement, in particular a delivery device of the gas pump 10 and a delivery device of the liquid pump 20, such that they can be moved; a housing part 2 which forms a cover of the gas pump 10; and a housing part 27 which forms a cover of the liquid pump 20. The housing part 1 is formed—expediently, cast—in one piece. In principle, however, it can instead also be joined from a plurality of pieces. The housing parts 2 and 27 are each formed in one piece and joined to the housing part 1, for example by means of a screw connection in each case, as shown.

The gas pump 10 and the liquid pump 20 are embodied as rotary pumps. The rotary pumps 10 and 20 are arranged coaxially, one axially behind the other, along a common rotational axis. The housing part 1 is axially arranged centrally. The housing part 2 is arranged on one axial front face of the housing part 1, and the housing part 27 is arranged on the other axial front face of the housing part 1.

The delivery device of the gas pump 10 comprises a delivery rotor 11, which can be rotated about the rotational axis, and a single vane 12. The delivery device is correspondingly single-vaned. The delivery rotor 11 radially guides the vane 12 such that it can be shifted. In the region of the gas pump 10, the housing part 1 forms a housing cup which delineates a delivery chamber 3 on a front face axially facing the liquid pump 20 and surrounds it over its circumference. When the delivery rotor 11 is rotary-driven, the vane 12 revolves in the delivery chamber 3 and divides the delivery chamber 3 into a delivery cell which increases in size on a low-pressure side of the gas pump 10 and another delivery cell which decreases in size on the high-pressure side of the gas pump 10. The increase in the size of the delivery cell causes gas to be suctioned on the low-pressure side through an inlet 4 into the enlarging delivery cell and then expelled through an outlet 5 on the high-pressure side when the delivery cell decreases in size. The gas pump 10 can in particular be operated as a negative pressure pump or vacuum pump in order for example to supply a brake servo of a vehicle with negative pressure. In such an application, the brake servo or another or an additional assembly of the vehicle which is to be supplied with negative pressure is connected to the inlet 4, and the suctioned gas—preferably, air—is expelled into the environment via the outlet 5, for example into a crankcase of an internal combustion engine, wherein a lubricant which serves to lubricate the delivery device 11, 12 is simultaneously also expelled through the outlet 5.

The housing part 2 seals the delivery chamber 3 on one front face. FIG. 1 shows the housing part 2 before it is mounted, in a position in which the housing part 2 lies axially opposite the facing open front face of the housing part 1 and then has only to be axially pressed against and fixedly connected to the housing part 1 in order to seal the delivery chamber 3. Once they have been joined, a sealing surface 6 of the housing part 1 which axially faces the housing part 2 and a sealing surface 7 of the housing part 2 which axially faces the housing part 1 abut each other axially and form a sealing join which extends around the delivery chamber 3, in order to seal off the delivery chamber 3 over its circumference. In the sealing surface 6, a groove-shaped sealing recess 9 is formed over the entire circumference of the delivery chamber 3. In conventional gas pumps, a sealing ring is arranged in a sealing recess which is comparable in terms of shape, and the sealing ring is elastically pressed when the housing parts 1 and 2 are joined, thus ensuring that the sealing join is sealed off as is required. Unlike with conventional seals, however, the sealing join between the sealing surfaces 6 and 7 is ensured by a sealing liquid situated in the sealing recess 9. The sealing recess 9 is filled with the sealing liquid at least during pump operations. An elastic sealing ring or other sealing element is not required in order to seal off the sealing join 6, 7. In the example embodiment, the housing part 1 comprises a sealing recess 9 for the sealing liquid. In a modification, a sealing recess corresponding to the sealing recess 9 could instead also be provided in the sealing surface 7 of the housing part 2 only. It would in principle also be conceivable to provide a sealing recess in each of the two sealing surfaces 6 and 7, which overlap or extend next to each other or also merely one behind the other in the circumferential direction and are filled with sealing liquid during pump operations.

Figure 2:
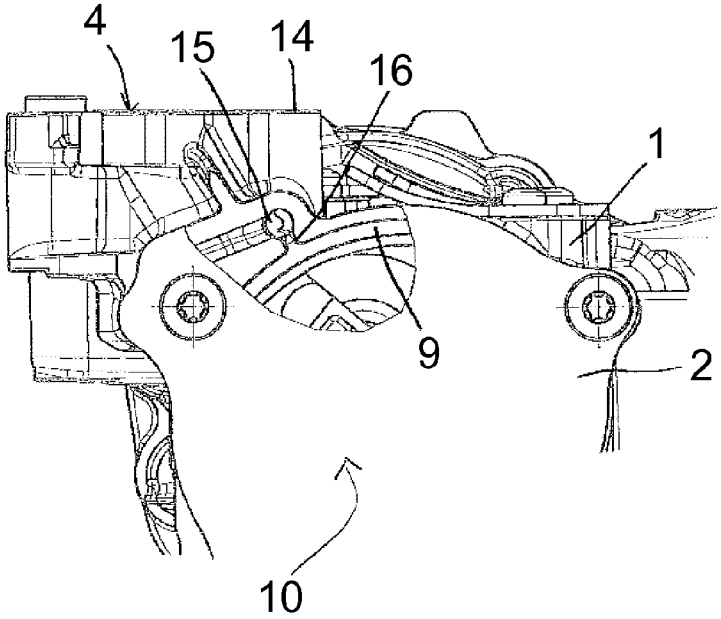
FIG. 2, which is an axial partial view onto a front face of the gas pump, shows the pump arrangement of the first example embodiment.

FIG. 2 shows the pump arrangement of the first example embodiment in an axial view onto the gas pump 10. The housing part 2 is joined to the housing part 1, but shown cut-away in a partial region, such that the sealing surface 6 and the sealing recess 9 are visible in this partial region and hidden in the remaining region by the housing part 2. The sealing recess 9 is not encapsulated but rather connected via a feed to a system from which sealing liquid can be guided into the sealing recess 9. Portions 15 and 16 of the feed can be seen which connect the sealing recess 9 to an inlet 14 for the sealing liquid. The inlet 14 is provided in the housing part 1. When the pump arrangement is mounted, for example on a combustion engine, the inlet 14 is connected to a liquid system which guides the sealing liquid. The feed 14, 15 and 16 is sealed off on the front face of the housing part 1 by the housing part 2 at the same time as the sealing recess 9. Forming the feed portions 15 and 16 as portions which are open towards the front face facilitates establishing the feed 14, 15 and 16. The portion 15 ports radially next to the sealing recess 9 and is connected to the sealing recess 9 via the portion 16 which is open towards the front face. In a modification, the portion 15 can however also overlap radially with the sealing recess 9, and the connecting portion 16 can correspondingly be omitted. The portion 15 can in particular be formed as an axial bore. Instead, however, an oblique bore or other profile could likewise be realised.

Figure 3:
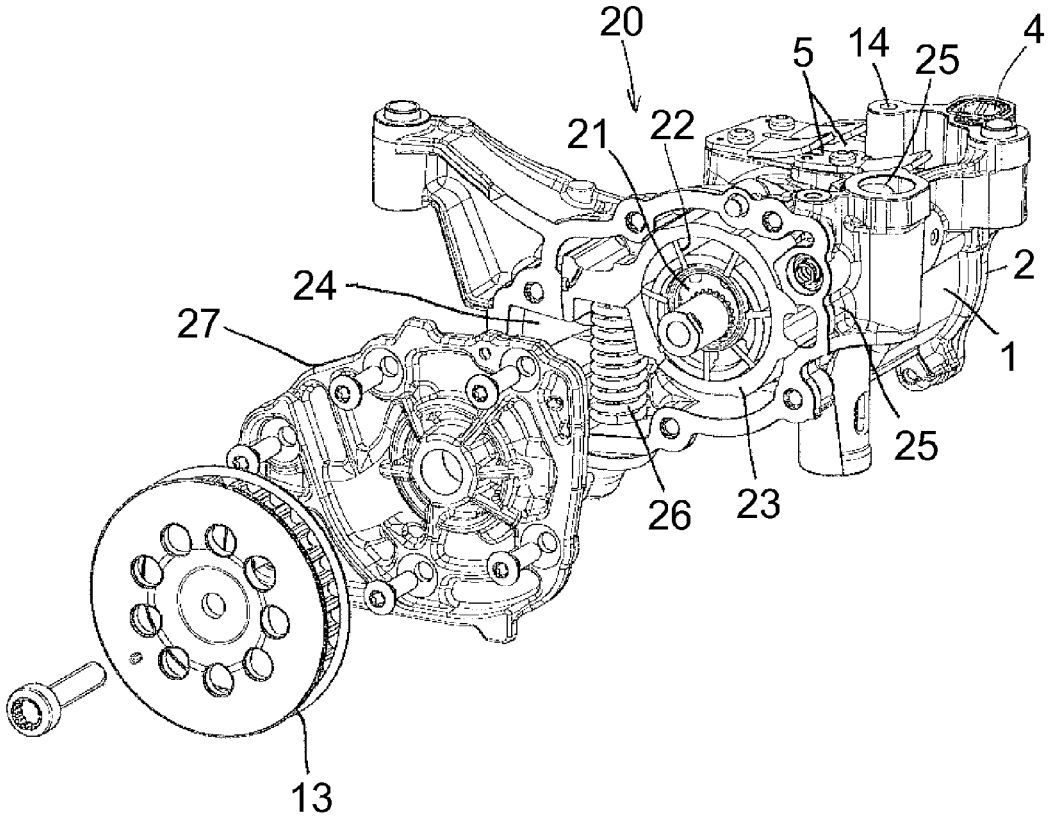
FIG. 3, which is an isometric view onto a liquid pump of the arrangement, shows the pump arrangement of the first example embodiment.

FIG. 3 shows the pump arrangement of the first example embodiment, in an isometric view onto the liquid pump 20. The liquid pump 20, like the gas pump 10, is a vane cell pump. Unlike the gas pump 10, the liquid pump 20 comprises a multi-vaned delivery device featuring a delivery rotor 21, which can be rotated about the rotational axis which it has in common with the gas pump 10, and a plurality of vanes 22 which are arranged in a distribution over the circumference of the delivery rotor 21. The liquid pump 20 can be adjusted in terms of its specific delivery volume. It comprises a setting ring 23 which is mounted such that it can be pivoted relative to the housing part 1, in order to be able to adjust an eccentricity of the delivery device 21, 22 and therefore the specific delivery volume of the liquid pump 20. A restoring spring 26 exerts a restoring force, which acts in the direction of a maximum delivery volume, on the setting ring 23. The pressure liquid delivered by the liquid pump 20 is applied to the setting ring 23 in the direction of reducing the specific delivery volume, i.e. acting counter to said restoring force. The vanes 22 sub-divide a delivery chamber of the liquid pump 20 into delivery cells which increase in size on a low-pressure side of the delivery chamber when the delivery device 21, 22 is rotary-driven and the setting ring 23 is positioned eccentrically relative to the rotational axis, thus suctioning liquid into the delivery chamber, and which decrease in size again on a high-pressure side of the delivery chamber, such that the liquid is expelled at an increased pressure through an outlet 25 on the high-pressure side. In FIG. 3, the entire inlet region on the low-pressure side of the liquid pump 20 is indicated by 24, and the entire outlet region on the high-pressure side is indicated by 25. The inlet region comprises an inlet 24 of the housing part 1, which can be seen in FIG. 1, and an inlet portion 24 which is located in the housing part 1 upstream of the delivery chamber and in which the restoring spring 26 is for example arranged and from which a chamber inlet leads directly into the delivery chamber. The outlet region comprises: the chamber outlet, which leads directly out of the delivery chamber; an outlet portion 25 which is formed in the housing part 1; and, downstream of the outlet portion 25, an outlet 25 of the housing part 1.

The sealing liquid of the gas pump 10 can in particular be liquid lubricant and expediently the same lubricant as is used to lubricate the delivery device 11, 12 and seal off, from each other, the delivery cells formed in the delivery chamber 3 of the gas pump 10. A certain, albeit slight permeability of the sealing join 6, 7 in the direction towards the delivery chamber 3 can therefore be present or even desired. The sealing join 6, 7 can be embodied such that when the gas pump 10 is in operation, a negative pressure which prevails in the delivery chamber 3 when the pump is being used as a negative pressure pump causes sealing liquid to penetrate from the sealing recess 9 inwards into the delivery chamber 3 in order to perform the functions mentioned, namely lubricating the delivery device 11, 12 and/or sealing off the delivery cells and/or cooling, in the delivery chamber 3, in co-operation with lubricant which is fed in other ways. Alternatively, it is in principle also conceivable for lubricating and sealing to be performed solely by the sealing liquid which penetrates from the sealing recess 9 into the delivery chamber 3. Preferably, however, lubricant is fed in other ways, for example centrally via a rotary bearing of the delivery rotor 11, at least in order to lubricate the delivery device 11, 12.

The liquid pump 20 can in particular be a lubricant pump for supplying an assembly with a liquid lubricant. In preferred applications, the liquid pump 20 is a lubricant pump for supplying a combustion engine, preferably a drive motor of a vehicle, with liquid lubricant.

In an advantageous combination, the sealing liquid for sealing off the gas pump is the liquid which is delivered by means of the liquid pump 20. In such embodiments, the feed 14, 15 and 16 is connected to the liquid system formed by means of the liquid pump 20. In the first example embodiment, the sealing recess 9 is connected to the high-pressure side of the liquid pump 20 via the feed 14, 15 and 16, such that the liquid pump 20 delivers the sealing liquid into the recess 9 at pressure via the feed 14, 15 and 16. If a filter device for cleaning the liquid delivered by the liquid pump 20 is arranged between the liquid pump 20 and the assembly to be supplied, then the sealing recess 9 can in particular be connected at a point between the filter device and the assembly to be supplied, by another feed portion diverging in the flow path of the liquid between the filter device and the assembly to be supplied, wherein said other feed portion connects the liquid system to the inlet 14 of the feed 14, 15 and 16. If the liquid is a lubricant and the gas pump 10 is not or at least not exclusively lubricated and/or sealed off using liquid from the sealing recess 9, then the same inlet 14 can also serve to guide the lubricant, needed for lubricating and sealing off, into the gas pump 10 by bypassing the sealing recess 9. The same liquid can also be used as a control pressure liquid for adjusting the specific delivery volume of the liquid pump 20, by applying the liquid—advantageously, cleaned liquid—to the sealing ring 23, counter to the restoring spring 26.

The pump arrangement is rotary-driven via a drive wheel 13. If the pump arrangement is assigned to a combustion engine, it can for example be driven by a crankshaft of the combustion engine via the drive wheel 13. The drive wheel 13 can be a component of a traction means gear system or also a component of a toothed wheel gear system or in principle also a component of a friction wheel gear system. The drive wheel 13 is mechanically coupled to both the delivery device 11, 12 and the delivery device 21, 22 and can in particular be non-rotationally connected to both delivery rotors 11 and 21.

The pump arrangement can be partially or completely immersed in a sump or other type of reservoir of a liquid, in particular a reservoir of the liquid which is delivered by the liquid pump 20. The pump arrangement can then be arranged in a lower region of a combustion engine, for example on a lower side of the combustion engine, such that it is partially or completely immersed in the lubricant sump of the combustion engine. Arranging it in a liquid reservoir, preferably a lubricant reservoir, is advantageous for sealing off the gas pump. Due to the negative pressure prevailing in the delivery chamber 3 during pump operations, lubricant is able and allowed to be suctioned from the environment—the reservoir—via the sealing join 6, 7 into the sealing recess 9 and from there into the delivery chamber 3. The lubricant which surrounds the outside of the gas pump and which also simultaneously serves as a sealing liquid, effectively prevents ambient air from being suctioned via the sealing join 6, 7 in the region surrounded by the lubricant, thus enabling the strength of seal on the gas pump and therefore its effectiveness and delivery rate to be improved.

The filter device mentioned is external in relation to the pump arrangement. It can for example be arranged such that it is integrated or mounted on the combustion engine. The housing outlet 25 of the liquid pump 20 and the inlet 14 of the gas pump 10 which leads to the sealing recess 9 are therefore connected to each other via the combustion engine or via a unit which is mounted on the combustion engine and comprises the filter device. Alternatively, however, the sealing recess 9 can also be connected to the high-pressure side of the liquid pump 20 via the feed portions 15 and 16 (FIG. 2) or via a feed formed in another way within the housing 1, 2, 27 of the pump arrangement, in order to feed the liquid delivered by the liquid pump 20 to the sealing recess 9 as a sealing liquid.

Figure 4:
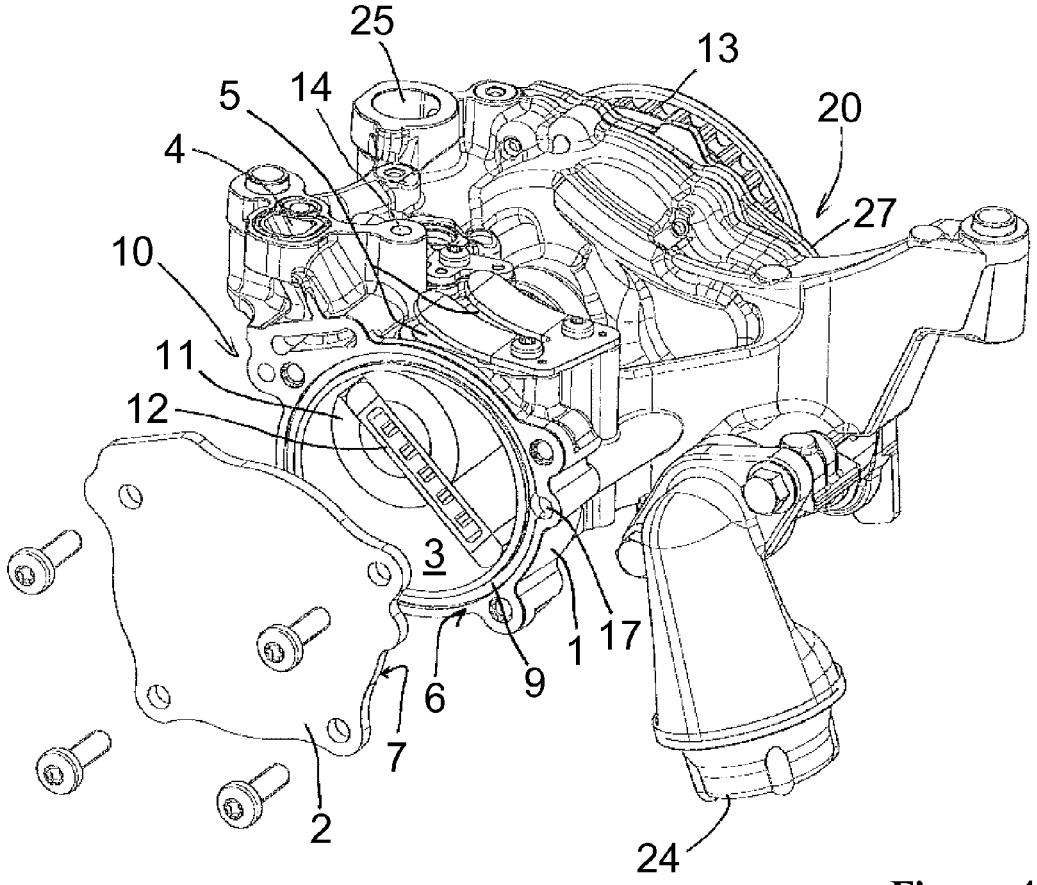
FIG. 4, which is an isometric view onto the gas pump, shows a pump arrangement comprising a gas pump of a second example embodiment.
Figure 5:
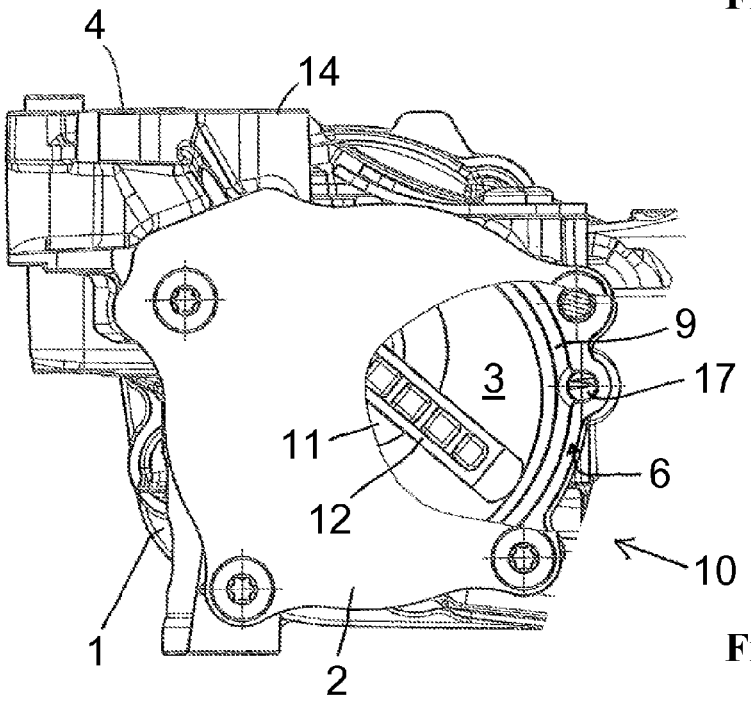
FIG. 5 which is an axial partial view onto a front face of the gas pump, shows the pump arrangement of the second example embodiment.
Figure 6:
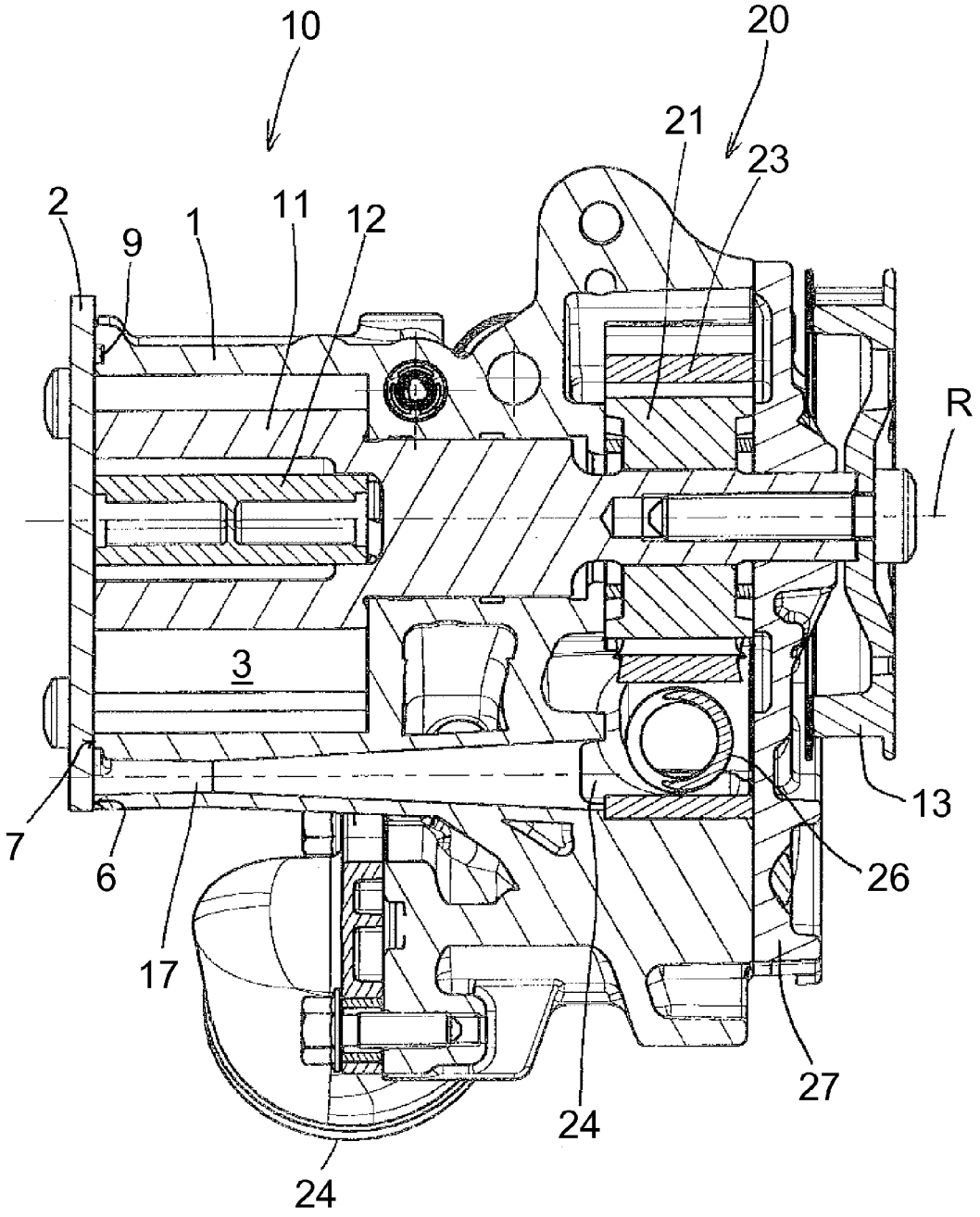
FIG. 6, which is a longitudinal sectional view, shows the pump arrangement of the second example embodiment.

FIGS. 4, 5 and 6 show a pump arrangement of a second example embodiment, which differs from the pump arrangement of the first example embodiment only in relation to feeding the sealing liquid into the sealing recess 9. FIG. 4 shows the pump arrangement of the second example embodiment in an isometric view onto the gas pump 10. FIG. 5 shows the pump arrangement in an axial view onto the gas pump 10, wherein the housing part 2 is cut-away in a partial region, in order to reveal the delivery chamber 3 and in particular the sealing surface 6 and the recess 9 in said partial region. In this respect, FIGS. 4 and 5 correspond to FIGS. 1 and 2 of the first example embodiment.

Unlike the first example embodiment, the sealing recess 9 is connected to the low-pressure side of the liquid pump 20 and is supplied with the sealing liquid via a feed 17 which is formed in or on the housing 1, 2 and 27. In the example embodiment, the feed 17 is formed in or on the housing part 1 and ports in the sealing surface 6 in which—as in the first example embodiment—the sealing recess 9 is also formed over the entire circumference of the delivery chamber 3. When the housing parts 1 and 2 are joined, the feed 17 is sealed together with the sealing recess 9 by the sealing surface 7 of the housing part 2.

FIG. 5 shows the geometric relationships in the porting region of the feed 17. The feed 17 ports in the sealing surface 6, directly adjacent to the sealing recess 9 radially on the outside. The housing part 1 bulges outwards in the region of the feed 17, in particular in the region of the sealing surface 6, in order to also provide a sufficient surface on the outside for sealing off the sealing join in the region of the feed 17 and/or its port.

FIG. 6 shows the pump arrangement of the second example embodiment in a longitudinal section which includes the rotational axis R which is common to both pumps 10 and 20. As can be seen in this section in particular, the housing of the pump arrangement comprises three parts, being the central housing part 1 and the two front-facing housing parts 2 and 27 which serve as housing covers. As can also be seen, a shaft which can be rotated about the rotational axis R extends axially through the housing part 1, and in the example also through the housing part 27, and which forms the delivery rotor 11 of the gas pump in one piece and on which the delivery rotor 21 (FIG. 3) of the liquid pump 20 is non-rotationally arranged. The drive wheel 13 is likewise connected non-rotationally to the shaft, such that by rotary-driving the drive wheel 13, the shaft and consequently the two delivery rotors 11 and 21 are jointly rotary-driven. A portion of the housing part 1 located axially between the gas pump and the liquid pump forms a rotary slide bearing for the shaft.

The feed 17 extends through the housing part 1, axially in a straight line in the second example embodiment, and ports on the low-pressure side of the liquid pump 20 into the inlet portion 24 of the inlet region in which the restoring spring 26 is arranged. When the liquid pump 20 is rotary-driven, the liquid suctioned by the liquid pump 20 is fed, as a sealing liquid, through the feed 17 to the sealing recess 9 due to its inflow speed and/or kinetic energy. If the gas pump 10 is operated as a negative pressure pump and a connection exists between the sealing recess 9 and the delivery chamber 3 which allows a slight flow of sealing liquid from the sealing recess 9 into the delivery chamber 3, then such a suction effect can assist or as applicable even solely perform the delivery of the sealing liquid into the sealing recess 9.

The feed 17 advantageously diverges on the low-pressure side of the liquid pump 20 at a point which is geodetically above the liquid level which is established when the liquid pump 20 is at a stop. In view of the pump geometry of the example embodiment, this means that the pump arrangement is only partially immersed in the liquid when this constraint is observed.

Aside from the differences described, the pump arrangement of the second example embodiment corresponds to that of the first example embodiment, such that reference is otherwise made to the statements made with respect to that embodiment.

In the example embodiments, the housing parts 2 and 27 are each formed as simple covers which cover the delivery chamber 3 and the delivery chamber of the liquid pump 20 at one open axial front face of the housing part 1 each. In a modification, the housing part 2 can for example form not only the front face but also the circumferential wall of the delivery chamber 3. In such modifications, the sealing join 6, 7 would not be arranged on the front face of the delivery chamber 3 which is on the left in FIG. 6, as in the example embodiments, but rather on the front face of the delivery chamber 3 which is on the right, either in the sealing surface of the modified housing part 2 which is then formed there or preferably in the sealing surface of the modified, i.e. shortened housing part 1 which then lies axially opposite.

What is claimed:

1. A gas pump, comprising:

a first housing part comprising a first sealing surface;

a second housing part comprising a second sealing surface;

a delivery chamber comprising an inlet and an outlet for a gas; and a delivery device, which is movable within the delivery chamber, for delivering the gas, wherein the first and second housing parts are joined to each other such that they at least partially enclose the delivery chamber over a circumference of the chamber, and such that the first and second sealing surfaces abut each other in order to seal off the delivery chamber, and wherein a sealing recess extends in at least one of the first and second sealing surfaces around the delivery chamber and is filled with a sealing liquid when the gas pump is in operation; and wherein the gas pump is a negative pressure pump for supplying one or more assemblies with negative pressure and wherein a liquid lubricant, which serves to lubricate the delivery device or seal off delivery cells within the delivery chamber, also forms the sealing liquid.

2. The gas pump according to claim 1, wherein the one or more assemblies are part of a motor vehicle.

3. The gas pump according to claim 1, wherein the sealing recess is connected via a feed to a reservoir or circulation of the sealing liquid, such that the sealing liquid can be fed to the sealing recess.

4. The gas pump according to claim 1, wherein a feed for the lubricant is connected to the sealing recess and/or in that lubricant which serves as the sealing liquid in the sealing recess can penetrate from the sealing recess into the delivery chamber.

5. A gas pump according to claim 1, wherein a liquid pump is provided for supplying an assembly with a liquid which also forms the sealing liquid;

the liquid pump comprises a delivery chamber and a delivery device which can be moved within the delivery chamber, and the delivery chamber comprises an inlet on a low-pressure side of the liquid pump and an outlet on a high-pressure side of the liquid pump, for the liquid; and a feed is provided which connects the sealing recess to the low-pressure side or the high pressure side of the liquid pump.

6. A gas pump according to claim 5, wherein the liquid pump is a lubricant pump and the liquid is a lubricant which serves to lubricate the assembly.

7. The gas pump according to claim 5, wherein one of the first and second housing parts of the gas pump forms one or more chamber walls of the delivery chamber of the liquid pump.

8. The gas pump according to claim 7, wherein the first and second housing parts of the gas pump form a front-facing wall and a circumferential wall.

9. The gas pump according to claim 5, wherein a feed diverges on the high pressure side of the liquid pump and is connected to the sealing recess such that liquid delivered by the liquid pump can pass through the feed into the sealing recess.

10. The gas pump according to claim 9, wherein the feed diverges on the high pressure side of the liquid pump downstream of the delivery chamber of the liquid pump.

11. The gas pump according to claim 5, wherein a filter device for cleaning the liquid is provided downstream of the delivery chamber of the liquid pump and the feed diverges downstream of the filter device.

12. The gas pump according to claim 11, wherein the filter device is upstream of the assembly to be supplied and the feed diverges upstream of the assembly.

13. The gas pump according to claim 5, wherein a feed which diverges on the low pressure side of the liquid pump is connected to the sealing recess such that liquid suctioned by the liquid pump can pass into the sealing recess.

14. The gas pump according to claim 5, wherein the feed diverges within a housing of the liquid pump.

15. The gas pump according to claim 14, wherein the feed diverges within a housing of the liquid pump on the low-pressure side of the liquid pump upstream of the delivery chamber of the liquid pump.

16. The gas pump according to claim 1, wherein the sealing recess can be supplied with the sealing liquid via a feed which diverges at a point of divergence from a supply system for supplying an assembly with a liquid, and the point of divergence or a portion of the feed which extends between the point of divergence and the sealing recess is geodetically higher than a liquid level which is established in the supply system when the gas pump, or a liquid pump which serves to deliver the liquid in the supply system, is at a stop.

17. The gas pump according to claim 1, wherein the gas pump is arranged at least partially immersed in liquid and the liquid at least partially surrounds the sealing surfaces on an exterior side which faces away from the delivery chamber of the gas pump.

18. The gas pump according to claim 1, wherein the gas pump is arranged on a combustion engine or driven by the combustion engine, and a lubricating liquid which serves to lubricate the combustion engine forms the sealing liquid.

19. The gas pump according to claim 1, wherein the delivery device of the gas pump and a delivery device of a liquid pump are arranged in a housing which comprises the first and second housing parts, such that they can be moved and/or rotated.

20. The gas pump according to claim 19, wherein the delivery devices can be rotated about the same rotational axis.

21. A vehicle comprising: a combustion engine;

a gas pump according to claim 1;

an assembly to which negative pressure or positive pressure relative to the ambient pressure of the vehicle can be applied by means of the gas pump; and a lubricant circulation for supplying each of the combustion engine and the gas pump with liquid lubricant, wherein the sealing recess which serves to seal off the gas pump is connected to the lubricant circulation, such that the lubricant forms the sealing liquid.

22. The vehicle according to claim 21, wherein the gas pump is mechanically coupled to the combustion engine in order to be driven thereby.

* * * * *